US010995292B2

(12) United States Patent
Ota et al.

(10) Patent No.: US 10,995,292 B2
(45) Date of Patent: May 4, 2021

(54) NANO PEROVSKITE MATERIALS AS COMBUSTION IMPROVER FOR LIQUID AND GASEOUS FUELS

(71) Applicant: Indian Oil Corporation Limited, Mumbai (IN)

(72) Inventors: Jyotiranjan Ota, Faridabad (IN); Samik Kumar Hait, Faridabad (IN); Madhira Indu Sekhara Sastry, Faridabad (IN); Gurpreet Singh Kapur, Faridabad (IN); Sankara Sri Venkata Ramakumar, Faridabad (IN)

(73) Assignee: Indian Oil Corporation Limited, Mumbai (IN)

( * ) Notice: Subject to any disclaimer, the term of this patent is extended or adjusted under 35 U.S.C. 154(b) by 2 days.

(21) Appl. No.: 16/351,314

(22) Filed: Mar. 12, 2019

(65) Prior Publication Data

US 2019/0276760 A1 Sep. 12, 2019

(30) Foreign Application Priority Data

Mar. 12, 2018 (IN) ..... 201821008904

(51) Int. Cl.
*C10L 1/30* (2006.01)
*C10L 10/10* (2006.01)
(Continued)

(52) U.S. Cl.
CPC ..... *C10L 1/301* (2013.01); *C10L 1/1233* (2013.01); *C10L 3/003* (2013.01); *C10L 10/10* (2013.01);
(Continued)

(58) Field of Classification Search
CPC ..... C10L 1/301; C10L 1/1233; C10L 3/003; C10L 10/10; C10L 2200/0446; C10L 2200/043; C10L 2200/0415; C10L 2200/0476; C10L 2200/0469; C10L 2200/0423; C10L 2200/0213; C10L 2200/0245; C10L 2200/0438; C10L 2200/024; C10L 2200/0218; C10L 2200/0254; C10L 2200/0236;
(Continued)

(56) References Cited

U.S. PATENT DOCUMENTS 7,169,196 B2 1/2007 Wakefield
2011/0099987 A1 5/2011 Satou et al.
(Continued)

FOREIGN PATENT DOCUMENTS

CN 106433819 * 2/2017

*Primary Examiner* — Cephia D Toomer
(74) *Attorney, Agent, or Firm* — Melissa M. Hayworth; E. Joseph Gess

(57) ABSTRACT

The present invention relates to use of Perovskite type of materials as combustion improver in gaseous and liquid fuels. Structurally, the Perovskite material consists of $ABO_3$, $A_xB_{1-x}C_yO_3$ or $A_xB_{1-x}C_yO_3$ kind of material with stoichiometric deficiency and oxygen deficient sites. More particularly, the present invention relates to the nanosized perovskite materials stably dispersed in hydrocarbon medium and compatible to the fuel has been used to improve the combustion process and generate more heat output.

8 Claims, 3 Drawing Sheets

(51) Int. Cl.
*C10L 3/00* (2006.01)
*C10L 1/12* (2006.01)

(52) U.S. Cl.
CPC . *C10L 2200/024* (2013.01); *C10L 2200/0213* (2013.01); *C10L 2200/0218* (2013.01); *C10L 2200/0231* (2013.01); *C10L 2200/0236* (2013.01); *C10L 2200/0245* (2013.01); *C10L 2200/0254* (2013.01); *C10L 2200/043* (2013.01); *C10L 2200/0415* (2013.01); *C10L 2200/0423* (2013.01); *C10L 2200/0438* (2013.01); *C10L 2200/0446* (2013.01); *C10L 2200/0469* (2013.01); *C10L 2200/0476* (2013.01); *C10L 2230/22* (2013.01); *C10L 2250/06* (2013.01); *C10L 2290/24* (2013.01)

(58) Field of Classification Search
CPC ..... C10L 2200/0231; C10L 2230/22; C10L 2250/06; C10L 2290/24
See application file for complete search history.

(56) References Cited

U.S. PATENT DOCUMENTS

| | | | |
|---|---|---|---|
| 2017/0089571 | A1 | 3/2017 | Orlovskaya et al. |
| 2017/0232387 | A1 | 8/2017 | Qi et al. |

* cited by examiner

NANO PEROVSKITE MATERIALS AS COMBUSTION IMPROVER FOR LIQUID AND GASEOUS FUELS

PRIORITY

This application claims priority to Indian Patent Application No. 201821008904 filed Mar. 12, 2018 entitled "Nano Perovskite Materials As Combustion Improver For Liquid And Gaseous Fuels", the contents of which are hereby incorporated by reference in their entirety.

FIELD OF THE INVENTION

The present invention relates to use of Perovskite type of materials as combustion improver in gaseous and liquid fuels. Structurally, the Perovskite material consists of $A_xB_{1-x}C_yO_3$ kind of material with stoichiometric deficiency and oxygen deficient sites. More particularly, the nanosized perovskite materials stably dispersed in hydrocarbon medium and compatible to the fuel has been used to improve the combustion process.

BACKGROUND

There is a continuous effort to increase the combustion efficiency of the fossil fuels available in various form, may it be gaseous or liquid. Alternative approaches are being deployed by automotive and petroleum companies to improve the fuel economy include formulating new fuels and engine oils. Complete combustion in IC engines and maximum heat through put from a fuel is the demand to meet. Further, achieving the 100% combustion and thereby getting a better fuel economy and highest heat throughput is always desirable.

In order to improve the combustion efficiency, a number of catalytic materials have been used as dispersion or on a porous media. These materials in general have stoichiomeric deficient sites where, oxygen is stored. Further, these materials act as a chemically active component by release of oxygen during the oxygen lean condition.

US patent application 2011/009987 discloses that oxygen storage materials such as cerium oxide and same doped with a number of transition metals have been used widely as diesel soot combustion improver and three-way catalysts. Due to their capabilities to oxidize the hydrocarbons and improve combustion, these materials in a stable dispersion form have also been used for catalyzing combustion in fuels, as disclosed in U.S. Pat. No. 7,169,196 B2.

Recently, a number of Perovskite structured materials in $ABO_3$ and $A_xB_{1-x}C_yO_3$ have been found to be better materials for (oxygen storage) OSC applications, as described in another US patent application 2017/0232387. Especially, the latter one with a double perovskite structure and stoichiometric oxygen deficient sites has an OSC many folds to that of cerium oxide. In fact, perovskite materials are also proposed to be better materials for three way catalytic applications according to US patent application 2017/0089571, which describes that un-burnt hydrocarbon molecules are converted into $CO_2$ and released.

It is evident that the perovskite materials are very good as oxygen storage material and proposed to be good candidate for three way catalytic application. However, the prior arts don't infer the perovskite materials as catalysts for increasing the heat through put, flame temperature and overall efficiency of the fuels, specifically for gaseous hydrocarbon fuels and atomized liquid hydrocarbons. In addition, the prior arts do not describe use of the perovskite materials as combustion improver of hydrocarbon fuels and further fail to describe increase in the efficiency of hydrocarbon fuels.

Furthermore, the prior-arts fail to disclose dispersion of the perovskite materials in the fuel matrix, which is a challenge. Propane and other gaseous fuels are being used for metal cutting applications, where the fuel burns at cutting nozzle. In case of gas fueled boilers the combustion takes place at burner nozzle. No effort has been reported in the prior-arts for increasing the efficiency or temperature output of flames generated through a nozzle on burner using the perovskite type materials.

Also, enhancement of the heat output and flame temperature through catalytic combustion, where catalyst is dispersed in fuel has not been reported so far.

Therefore, there is a need of a mechano-chemical process to reduce particle size of perovskite material in presence of suitable dispersant to make a stable dispersion in hydrocarbon fuel compatible matrix. Also, there is a need to prepare a stable dispersion of the perovskite materials by doping with hydrocarbon compatible media. The doping of hydrocarbon fuels with stable dispersion of Perovskite materials to catalyze the combustion process would in-turn lead to increase in the flame temperature and heat through put.

A top-down approach to grind the materials is adopted in presence of a suitable dispersant to make a stable dispersion of the perovskite materials in hydrocarbon compatible media. Nano-dispersion of the Perovskite type of materials in matrix compatible to the hydrocarbon fuels would serve the purpose to make such stable perovskite dispersion. The liquefied gaseous fuels doped with the prepared nano dispersion have been found to have better flame temperature compared to the neat fuel.

SUMMARY

The main objective of the present invention is to provide use of Perovskite type of materials as combustion improver in gaseous and liquid fuels.

Another objective of the invention, in particular, relates to a liquid dispersion composition for hydrocarbon fuels, comprising nano-perovskite materials, wherein the nano-perovskite materials comprises of at least one of $ABO_3$, $A_xB_{1-x}C_yO_3$, or $A_xB_{1-x}C_yD_{1-y}O_3$ kind of material with stoichiometric deficiency and oxygen deficient sites, wherein A represents La, Y, Sm, or Ce; B represents Ca, Ba, or Sr; C represents Mn, Co, Fe, Cu, or Ni; D represents Cr, Ru, or Fe; x is in the range of 0.15 to 0.95; and y is in the range of 0.15 to 0.95.

Another main objective of the present invention, relates to a additized fuel composition comprising a fuel doped with nano-perovskite materials, wherein the nano-perovskite materials comprises of at least one of $ABO_3$, $A_xB_{1-x}C_yO_3$, or $A_xB_{1-x}C_yD_{1-y}O_3$ kind of material with stoichiometric deficiency and oxygen deficient sites, wherein A represents La, Y, Sm, or Ce; B represents Ca, Ba, or Sr; C represents Mn, Co, Fe, Cu, or Ni; D represents Cr, Ru, or Fe; x is in the range of 0.15 to 0.95; and y is in the range of 0.15 to 0.95.

Still another objective of the invention is to provide preparation of stable liquid dispersion and additized fuel composition of the said nano-perovskite materials using a top-down approach in a matrix compatible to the fuel. The stable liquid dispersion containing nano-sized Perovskite have been doped into the hydrocarbon fuels at requisite concentrations, thereby increasing the efficiency.

DETAILED DESCRIPTION

Figure 1:
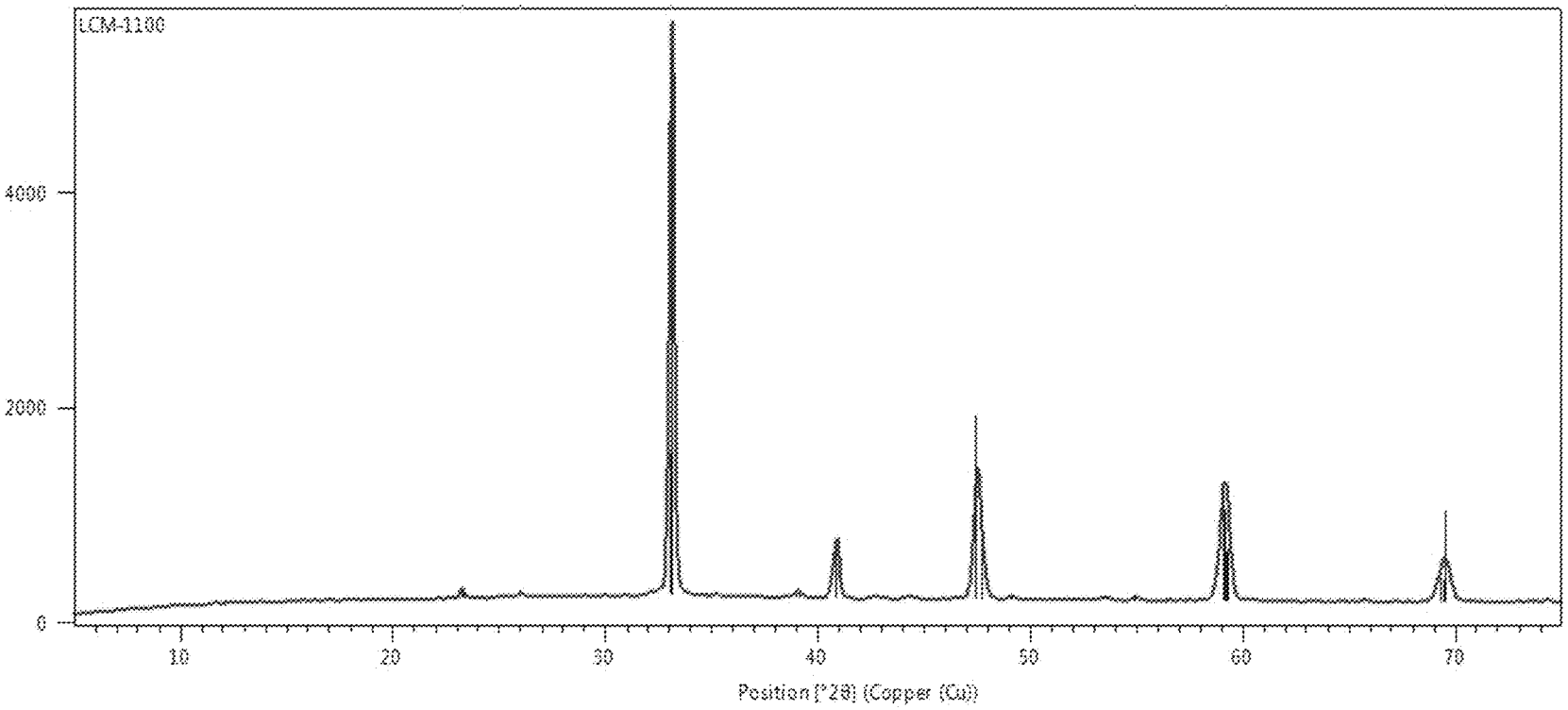
FIG. 1 is an XRD diffractogram of synthesized Perovskite $La_{0.5}Ca_{0.5}MnO_3$.

While the invention is susceptible to various modifications and/or alternative processes and/or compositions, specific embodiment thereof has been shown by way of example in tables and will be described in detail below. It should be understood, however that it is not intended to limit the invention to the particular processes and/or compositions disclosed, but on the contrary, the invention is to cover all modifications, equivalents, and alternative falling within the spirit and the scope of the invention as defined by the appended claims.

The tables and protocols have been represented where appropriate by conventional representations, showing only those specific details that are pertinent to understanding the embodiments of the present invention so as not to obscure the disclosure with details that will be readily apparent to those of ordinary skill in the art having benefit of the description herein.

The following description is of exemplary embodiments only and is NOT intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

In accordance to a main embodiment, the present invention provides the use of Perovskite type of materials as combustion improver in gaseous and liquid fuels.

In accordance to a preferred embodiment, the present invention provides a liquid dispersion composition comprising nano-perovskite materials and hydrocarbon medium, wherein the nano-perovskite materials.

In accordance to another preferred embodiment, the present invention provides an additized fuel composition comprising, a fuel doped with nano-perovskite material.

In accordance to a preferred feature of the present invention, the perovskite materials or the nano-perovskite materials included here, but not limited are represent by a kind of stoichiometry with at least one of general formula:

$$ABO_3 \quad \text{(I) or}$$

$$A_xB_{1-x}C_yO_3 \quad \text{(II) or}$$

$$A_xB_{1-x}C_yD_{1-y}O_3 \quad \text{(III),}$$

wherein A represents La, Y, Sm, or Ce; B represents Ca, Ba, or Sr; C represents Mn, Co, Fe, Cu, or Ni; D represents Cr, Ru, or Fe; x is in the range of 0.15 to 0.95; and y is in the range of 0.15 to 0.95.

The perovskite materials are preferably prepared through comparatively low temperature procedures in order to have a higher surface area and porosity. The process of preparation of the perovskite materials may be optimized to have better stoichimetry for improved oxygen release and storage.

In accordance to a specific feature of the present invention, the perovskite materials have a surface area in the range of 10 to 20 $m^2/g$, more preferably in the range of 25 to 100 $m^2/g$ or better.

In accordance to a feature of the present invention, the nano-particles of perovskite materials will have size not exceeding to 500 nm, more preferably below 100 nm. In another preferred feature of the present invention, the size of nanoparticles of the perovskite materials is in the range of 1 to 25 nm, more particularly in the range of 5 to 20 nm.

In accordance to another preferred embodiment, the present invention provides a process for preparation of the liquid dispersion composition, wherein the process comprises dispersing the nano-perovskite material in a non-reacting hydrocarbon medium using top-down approach to obtain the liquid dispersion.

In accordance to yet another preferred embodiment, the present invention also provides a process for preparation of the additized fuel composition, wherein the process comprises:

(a) dispersing the nano-perovskite material in a non-reacting hydrocarbon medium in a matrix using top-down approach to obtain liquid dispersion of the nano-perovskite material;

(b) doping the liquid dispersion of nano-perovskite material into a fuel to obtain the additized fuel composition.

In accordance to another feature of the present invention, the nano-Perovskite particles are combined with hydrocarbon fuel to improve the combustion process and may be present in form of suspension or dispersion.

In accordance to a preferred feature of the present invention, the Perovskite materials are dispersed in non-reacting hydrocarbon medium compatible to the fuel. A mechanochemical procedure employed for the preparation includes, but not limited to grinding, high speed shearing, or sonicating of the perovskite materials to reduce the size of the perovskite material to obtain nanoparticles.

In accordance to another feature of the present invention, it is preferred that the nanoparticles of the perovskite materials are coated to prevent agglomeration. Further, in accordance to yet another feature of the present invention, a dispersant for stabilizing the nanoparticles has been used compatible to the matrix and fuel composition.

In accordance to yet another feature of the present invention, a specific amount/concentration of the nano-perovskite materials is to be doped in the fuel matrix. The amount of nano-perovskite varies depending upon the nature and composition of the fuel. In accordance to a preferred feature of the present invention, the composition of fuel comprises of the nanoparticles in the range of 1 to 200 ppm, preferably 10 to 50 ppm, and more preferably in the range of 10 to 30 ppm of catalytic materials. The catalytic material is the nanoparticles of perovskite dispersed in the fuel medium. The dispersed nanoparticles further catalyze the combustion process.

In accordance to another embodiment of the present invention, the fuel is selected from a group consisting of at least one of be propane, butane, liquefied petroleum gas (LPG), diesel, gasoline, gasoline-alcohol blend, diesel-alcohol blend, diesel-biodiesel blend, kerosene, MTO, fuel oil, and mixtures thereof at different ratios. More preferably, the fuel under subject is selected from a group consisting of at least one of Liquefied natural gas (LNG) and compressed natural gas (CNG) at different composition.

In accordance to a preferred feature of the present invention, the hydrocarbon medium is same as the fuel. The hydrocarbon medium may also optionally be selected from at least one of the group of hydrocarbon compatible to the fuel.

In accordance to another feature of the present invention, but not limited to, application of the additized fuel composition doped with the nano-perovskite materials include high temperature applications such as metal cutting, brazing, soldering etc., where a high flame temperature is desirable. The additized fuel is also suitable for LPG/propane fired boilers, automotive applications, etc.

In accordance to yet another feature of the present invention, the perovskite containing liquid fuels may also be suitable for IC engines based on diesel and MS. Further, the dispersion of Perovskite material in fuel may also be used for heating, annealing, power and steam generation through boilers and furnaces application etc., where requirement of heat is present in industry.

In accordance to an embodiment, the advantages of the present invention include improvement in flame temperature of gaseous fuels on using the nano-perovskite materials. The improved flame temperature or combustion are at least 3-5 times better in terms of oxygen storage and release than the state of art materials based on cerium oxide. The Perovskite materials have been dispersed in hydrocarbon medium stable enough and compatible with the hydrocarbon based fuels. The fuel gas doped with the prepared nano dispersion has been found to have better flame temperature compared to the neat fuel. Liquid fuel doped with the dispersion at requisite doping shows better combustion efficiency and fuel economy

EXAMPLES

The present invention is exemplified by following non-limiting examples:

Example 1

Perovskite materials may be synthesized in a number of procedures depending upon the precursor and severity of reaction. A modified pechini method has been used for the same purpose as the method creates more porous structures. In the present process for the materials preparation we have played with the annealing temperature to get the best porous and relatively higher surface area material. A number of perovskites with variation of the metals and their stoichiometry have been synthesized. A typical XRD obtained for one of the composition shown in FIG. 1 corresponds to $La_{0.5}Ca_{0.5}MnO_3$.

Example 2

Figure 2:
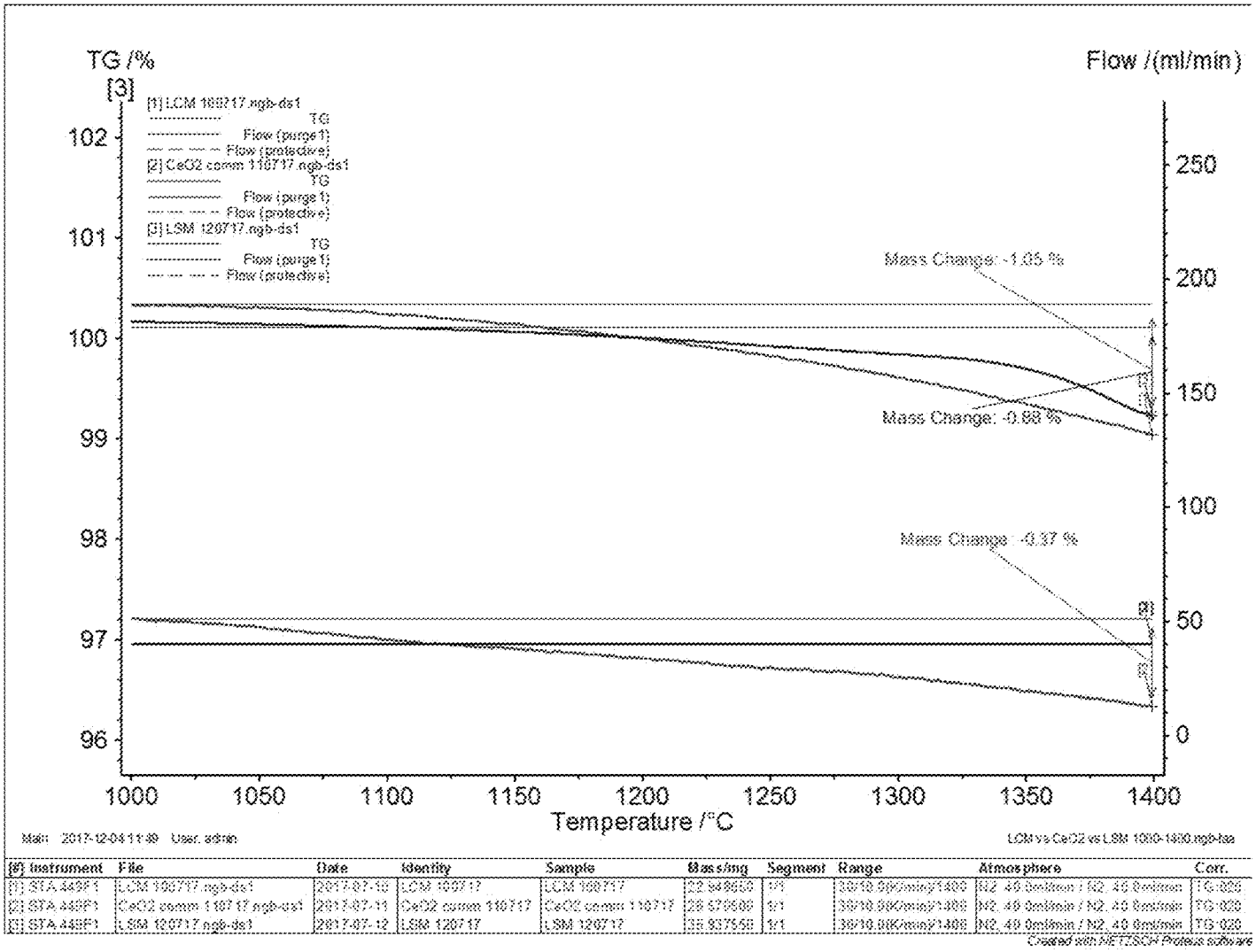
FIG. 2 is a TGA curve of Perovskite showing mass change in range of 1000-1400° C.

Oxygen storage capacity of the materials studied in terms of oxygen release at higher temperatures using TGA curve. Two of the synthesized perovskite structures subjected to the TGA under nitrogen atmosphere from ambient to 1400° C. The actual release of oxygen occurs at high temperature and that zone i.e. 1000-1400° C. is shown in FIG. 2 along with the same for cerium oxide as a reference material. It can be observed that the two perovskite structures under study have released oxygen 2.83 and 2.37 times than that of the reference cerium oxide.

Comparative Study of Oxygen Release Properties:

A comparative study of oxygen release in thermogravimetric analysis (TGA) has been shown in FIG. 2. The values have been tabulated below in Table 1 in comparison to reference ($CeO_2$)

TABLE 1

| Sample Name | $O_2$ release (%) @1400° C. |
|---|---|
| $CeO_2$ (Ref) | 0.37 |
| $La_{0.5}Sr_{0.5}MnO_3$ (LSM) | 0.88 |
| $La_{0.5}Ca_{0.5}MnO_3$ (LCM) | 1.08 |

Example 3

Figures 3A, 3B:
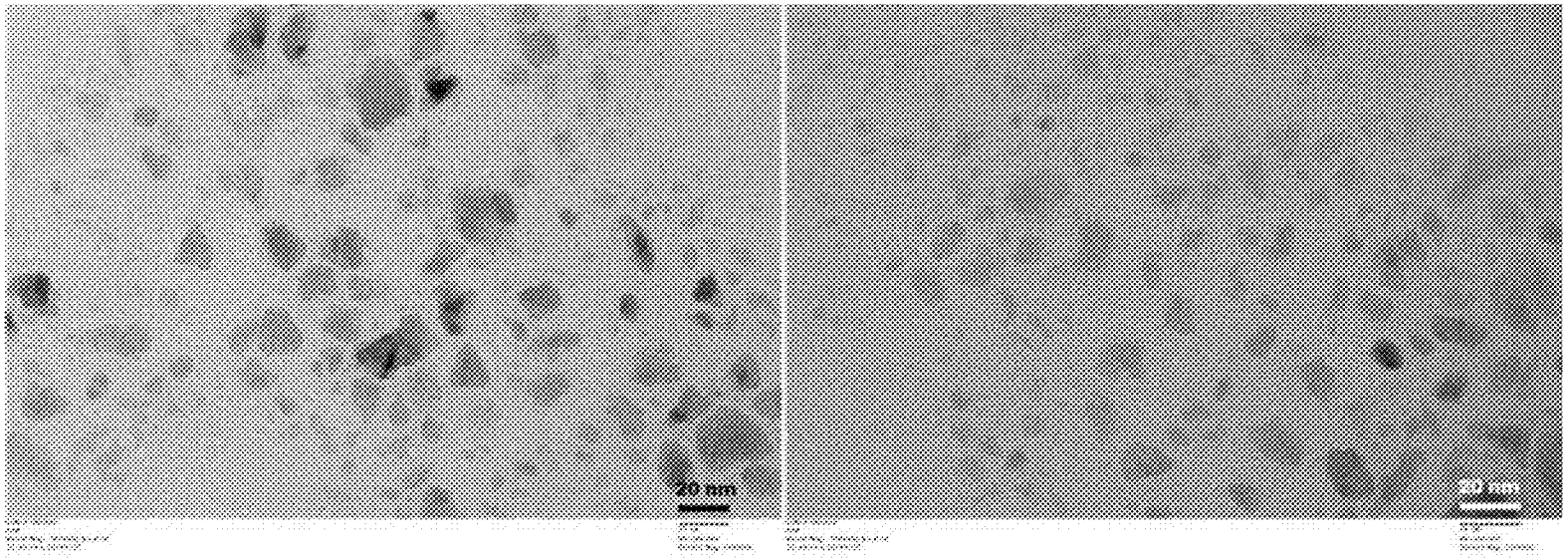
FIGS. 3A and 3B are TEM images of the Perovskite structure after milling process.

In second example, the perovskite material synthesized was subjected to sequential milling in presence of a suitable dispersant to reduce the size and make a stable dispersion in the matrix. The matrix was carefully chosen so that the dispersion is compatible with the hydrocarbon content of the fuel. As a result of the ball milling a stable dispersion of the perovskite in hydrocarbon matrix obtained. The size of all the particles as observed by the TEM (FIGS. 3A and 3B) found less than 30 nm, where most of the particles found below 10 nm in size.

Example 4

Another aspect of the study is to dope the perovskite nano-dispersions in hydrocarbon fuels and evaluate the efficiency. The nano-dispersion was doped into liquefied propane and LPG. The flame was generated and the temperature of inner core of the flame was measured by using a thermocouple. The Experimental flame temperature obtained found at least 600° C. more than the gaseous fuel under study.

Comparative Study of Flame Temperature Study

Flame temperature of neat propane under oxygen and same additized with reference and one of the selected nano-perovskite (LCM) has been shown in table 2 below.

TABLE 2

| Gaseous Fuel | Flame Temp. (° C.) (Experimental) |
|---|---|
| Propane | 1920 |
| Propane added $CeO_2$ Nanoparticles | 2250 |
| Propane added with Nano Perovskite (LCM) | 2545 |

Those of ordinary skill in the art will appreciate upon reading this specification, including the examples contained herein, that modifications and alterations to the composition and the process of making the composition may be made within the scope of the invention and it is intended that the scope of the invention disclosed herein be limited only by the broadest interpretation of the appended claims to which the inventor is legally entitled.

What is claimed is:

1. A liquid dispersion composition comprising:

nanosized-perovskite materials having a size in the range of 5-20 nm and a hydrocarbon medium, wherein the hydrocarbon medium is a fuel or a hydrocarbon compatible with a fuel, and wherein the fuel is selected from the group consisting of propane, butane, liquefied petroleum gas (LPG), diesel, gasoline, gasoline-alcohol blend, diesel-alcohol blend, diesel-biodiesel blend, kerosene, mineral turpentine oil (MTO), fuel oil, and combinations thereof, wherein the nanosized-perovskite materials are represented by at least one of a general formula (I), (II), or (III):

$ABO_3$, (I), $A_xB_{1-x}C_yO_3$ or (II), $A_xB_{1-x}C_yD_{1-y}O_3$ (III), wherein A represents La, Y, Sm, or Ce;
B represents Ca, Ba, or Sr;
C represents Mn, Co, Fe, Cu, or Ni;
D represents Cr, Ru, or Fe;
x is in the range of 0.15 to 0.50; and
y is in the range of 0.15 to 0.95, wherein the composition improves a combustion process.

2. The composition as claimed in claim 1, wherein the composition comprises nanoparticles in a concentration range of 1-200 ppm.

3. An additized fuel composition comprising:

a fuel doped with a liquid dispersion of nanosized-perovskite materials wherein the nanosized-perovskite materials are dispersed in a hydrocarbon medium, wherein the hydrocarbon medium is a fuel or a hydrocarbon compatible with a fuel, and wherein the fuel is selected from the group consisting of propane, butane, liquefied petroleum gas (LPG), diesel, gasoline, gasoline-alcohol blend, diesel-alcohol blend, diesel-biodiesel blend, kerosene, mineral turpentine oil (MTO), fuel oil, and combinations thereof, wherein the nanosized-perovskite materials have a size in a range of 5-20 nm, and wherein the nanosized-perovskite materials are represented by at least one of a general formula (I), (II), or (III):

$ABO_3$, (I), $A_xB_{1-x}C_yO_3$ or (II), $A_xB_{1-x}C_yD_{1-y}O_3$ (III), wherein A represents La, Y, Sm, or Ce;
B represents Ca, Ba, or Sr;
C represents Mn, Co, Fe, Cu, or Ni;
D represents Cr, Ru, or Fe;
x is in the range of 0.15 to 0.50; and
y is in the range of 0.15 to 0.95;

wherein the additized fuel composition increases flame temperature of a fuel to which it is added from about 1900° C. to about 2600° C.

4. The composition as claimed in claim 3, wherein the composition comprises nanoparticles in a concentration range of 1-200 ppm.

5. A process for preparation of a liquid dispersion composition, wherein the process comprises:

grinding perovskite material in a non-reacting hydrocarbon medium to provide a nanosized-perovskite material having a size in a range of 5-20 nm in the non-reacting hydrocarbon medium as the liquid dispersion;

wherein the non-reacting hydrocarbon medium is a fuel or a hydrocarbon compatible with the fuel, and wherein the fuel is selected from the group consisting of propane, butane, liquefied petroleum gas (LPG), diesel, gasoline, gasoline-alcohol blend, diesel-alcohol blend, diesel-biodiesel blend, kerosene, mineral turpentine oil (MTO), fuel oil, and combinations thereof.

6. The process as claimed in claim 5, wherein the nanosized-perovskite materials are represented by at least one of a general formula (I), (II), or (III):

ABO3, (I),

AxB1-xCyO3 or (II),

AxB1-xCyD1-yO$_3$ (III), wherein A represents La, Y, Sm, or Ce;
B represents Ca, Ba, or Sr;
C represents Mn, Co, Fe, Cu, or Ni;
D represents Cr, Ru, or Fe;
x is in the range of 0.15 to 0.50; and
y is in the range of 0.15 to 0.95.

7. A process for preparation of an additized fuel composition, wherein the process comprises:

(a) dispersing a nanosized-perovskite material, having a size in a range of 5-20 nm, in a non-reacting hydrocarbon medium in a matrix and obtaining a liquid dispersion of the nanosized-perovskite material; wherein the non-reacting hydrocarbon medium is a fuel or a hydrocarbon compatible with a fuel, and wherein the fuel is selected from the group consisting of propane, butane, liquefied petroleum gas (LPG), diesel, gasoline, gasoline-alcohol blend, diesel-alcohol blend, diesel-biodiesel blend, kerosene, mineral turpentine oil (MTO), fuel oil, and combinations thereof; and (b) doping the liquid dispersion of the nanosized-perovskite material into a fuel to obtain the additized fuel composition, wherein the additized fuel composition is a liquid fuel or a gaseous fuel and wherein the additized fuel composition enhances flame temperature of a fuel to which it is added from about 1900° C. to about 2600° C. for high temperature applications.

8. The process as claimed in claim 7, wherein the nanosized-perovskite materials are represented by at least one of a general formula (I), (II), or (III):

$ABO_3$, (I), $A_xB_{1-x}C_yO_3$ or (II), $A_xB_{1-x}C_yD_{1-y}O_3$ (III), wherein A represents La, Y, Sm, or Ce;
B represents Ca, Ba, or Sr;
C represents Mn, Co, Fe, Cu, or Ni;
D represents Cr, Ru, or Fe;
x is in the range of 0.15 to 0.50; and
y is in the range of 0.15 to 0.95.

* * * * *